United States Patent [19]

Standley

[11] 4,099,674

[45] Jul. 11, 1978

[54] NOZZLE MEMBER FOR A CONTAINER WASHING APPARATUS

[75] Inventor: Wendell Evert Standley, Lake Forest, Ill.

[73] Assignee: Abbott Laboratories, North Chicago, Ill.

[21] Appl. No.: 800,777

[22] Filed: May 26, 1977

Related U.S. Application Data

[63] Continuation of Ser. No. 660,587, Feb. 23, 1976, abandoned.

[51] Int. Cl.[2] ..... A47L 15/00; B05B 7/00; B67C 1/00

[52] U.S. Cl. ..... 239/431; 15/304; 134/152; 134/167 R; 134/171; 239/441; 239/552; 239/600; 285/39

[58] Field of Search ..... 239/416.5, 429–432, 239/436–439, 441, 461, 499, 504, 518, 524, 548, 552, 553, 553.3, 561, 590, 590.3, 597, 600, 602, DIG. 1, 457; 134/152, 166 R–169 R, 171, 188; 118/306, 317, 318, DIG. 10; 15/304; 285/39

[56] References Cited

U.S. PATENT DOCUMENTS

| | | | |
|---|---|---|---|
| 558,568 | 4/1896 | Sanders | 239/441 |
| 843,555 | 2/1907 | Weymar | 134/22 |
| 2,466,182 | 4/1949 | Peeps | 239/548 X |
| 2,475,407 | 7/1949 | Sell | 134/166 R X |
| 2,671,742 | 3/1954 | Cozzoli | 134/22 |
| 2,691,549 | 10/1954 | Hayward | 239/553.3 X |
| 3,044,475 | 7/1962 | Thompson | 134/166 R X |
| 3,060,943 | 10/1962 | Clayton | 15/304 X |

FOREIGN PATENT DOCUMENTS

| | | | |
|---|---|---|---|
| 2,263,266 | 7/1974 | Fed. Rep. of Germany | 239/518 |

*Primary Examiner*—Evon C. Blunk
*Assistant Examiner*—Andres Kashnikow
*Attorney, Agent, or Firm*—Robert L. Niblack; Neil E. Hamilton

[57] ABSTRACT

A nozzle member for an automatic washing apparatus for containers which nozzles are capable of washing containers in a fast and efficient manner. The containers for which this particular nozzle is fabricated are of the semirigid type and are composed of a plastic material. They are elongated in configuration and are intended to contain sterile liquids. The nozzle is fabricated to enter the plastic container and thoroughly wash it with a mixture of detergent, water, and air.

5 Claims, 14 Drawing Figures

NOZZLE MEMBER FOR A CONTAINER WASHING APPARATUS

This is a continuation, of application Ser. No. 660,587 filed Feb. 23, 1976, now abandoned.

BACKGROUND OF THE INVENTION

This invention relates to a continuous and automatic washing apparatus and method for washing containers. More particularly, it relates to an automatic washing device and method for washing containers wherein elongated plastic containers can be thoroughly washed by movement of a plurality of rows of semirigid containers over a plurality of nozzle members. The method encompasses the continuous inverting of a multiplicity of containers, holding the containers in a stationary manner while moving several nozzles with at least two separate streams of a washing fluid in and out of the containers with the washing fluid preferably composed of air, water and detergent. The machine best suited for accomplishing this method automatically grips the containers from an upright position and inverts them while holding the containers in a rigid manner during the washing by the nozzle members. At the end of the wash cycle, the containers are returned to an upright position.

The washing of semirigid containers, especially those which are to be utilized as containers for parenteral or body irrigation solutions, poses many problems in that the containers must be completely clean and free of particulate matter. Procedures and apparatus for washing containers for pharmaceutical purposes are described in U.S. Pat. Nos. 2,671, 742 and 3,060,943. Other apparatus for cleaning bottles to an ultraclean condition are described in U.S. Pat. No. 2,475,407 whereas U.S. Pat. No. 843,555 is directed to special holders for the bottles in a washing machine and additionally utilizes compressed air to force the cleansing fluid into the bottle. All of the prior art patents are concerned with washing glass or bottle-type containers which in most instances have sufficient weight so that they will be self-supporting and remain in a given position. The type of container which is intended to be washed by the method and device of this invention is described in a U.S. Pat. No. 4,013,187 entitled "Hanger Construction for Semirigid Plastic Container," issued Mar. 22, 1977. It is light in weight and has height much greater than its width to give the container an elongated configuration.

It is an advantage of the present invention to provide a novel apparatus and method for washing a container in a fast and efficient manner. It is another advantage of this invention to provide a method and apparatus for washing containers wherein each container is thoroughly washed by a combined fluid stream of water, detergent and air. It is still another advantage of this invention to provide a method and apparatus for washing semirigid containers which is adaptable to a high-speed, fully automated filling line. It is yet another advantage of this invention to afford a process and method for washing semirigid containers having an elongated configuration which can thoroughly wash the containers in a rapid manner and can subject each container to several separate washing cycles.

SUMMARY OF THE INVENTION

The foregoing objects are accomplished and the shortcomings of the prior art are overcome by the present process and apparatus wherein a multiplicity of containers are continuously inverted and moved in a sequential manner over a plurality of nozzle members. The nozzle members are moved into and out of the containers while a washing fluid is supplied under high pressure. The washing fluid is composed of a mixture of air and water and in a preferred manner two separate streams of washing fluid are directed simultaneously into each nozzle where it is thoroughly premixed and then applied in two streams inside each bottle. Many nozzles, adjacent to each other, are simultaneously moved first into and then out of a series of inverted bottles that are locked into holding and transporting means. A unique mechanism for effecting this method is a sequentially movable, releasable holding means for semirigid containers with means to grip and invert the semirigid containers into the holding means. A series of novel nozzles are provided for insertion into and out of adjacent semirigid containers with means to move the nozzles into and out of the containers as the containers are moved in a sequential manner over the nozzles. Means to release the containers from the holding means is also provided as well as means to continuously invert the containers over the nozzles and to later place them after washing in an upright position for further processing.

BRIEF DESCRIPTION OF DRAWINGS

A better understanding of the present method and apparatus for accomplishing it will be afforded by reference to the drawings wherein.

DESCRIPTION OF THE PREFERRED EMBODIMENT

Figure 1:
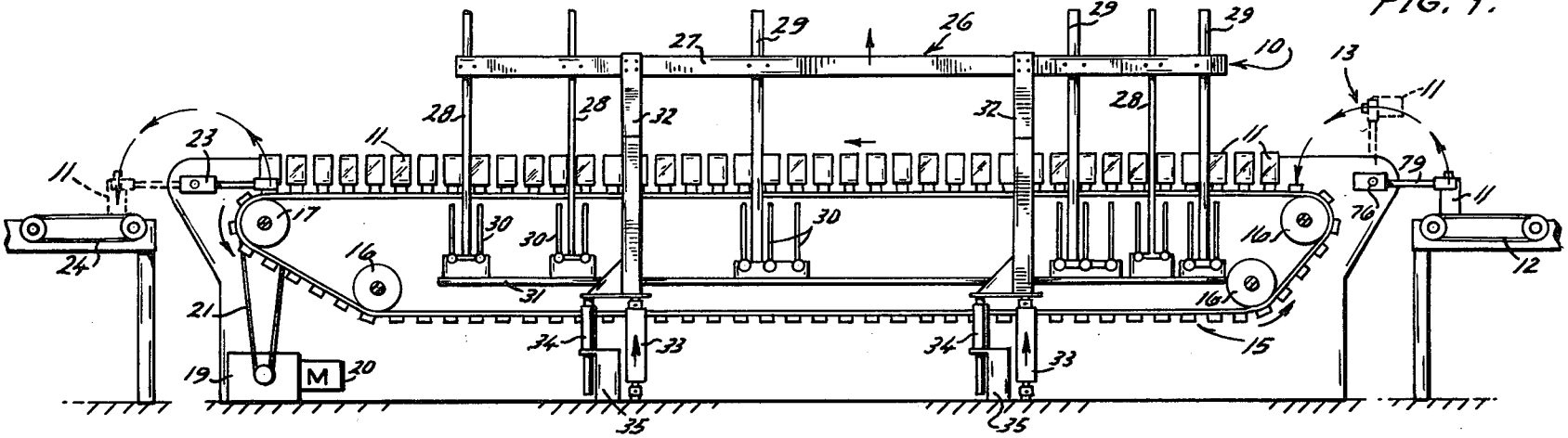
FIG. 1 is a view in side elevation illustrating the preferred apparatus for effecting the method of this invention.

The novel method for washing containers involves the continuous inverting of a multiplicity of the containers and holding them in a stationary manner. A first nozzle member is then moved into and out of the container while supplying a washing fluid in at least two streams inside the container. The container is then moved to a second nozzle member while the nozzle member with a similar two-stream ejection is also moved into and out of the container. In a preferred manner, the washing solution is composed of air and water and at least one of the washing cycles with the nozzle member does involve a detergent in the water. In order to assure that each container or bottle is thoroughly washed, the containers are sequentially passed over a multiplicity of nozzles so that only one nozzle contacts each container at a time, although each bottle will be washed by several individual nozzles. At the end of the cycle the containers are placed in an upright position.

An apparatus which can be advantageously employed for effecting the preceding method is shown in the drawings FIGS. 1–14. The washing apparatus 10 is shown with a multiplicity of semirigid containers 11 which are indicated in the inverted position on a conveyor 15 which is of the chain-link type. The usual drive sprocket 17 and idler sprockets 16 will move the conveyor from right to left in FIGS. 1 and 2 by means of motor 20, transmission 19 and drive chain 21 engaging suitable drive means in conjunction with drive sprocket 17. As the drive train and conveyor are standard items, no further discussion of them will be necessary. Containers 11 are placed on conveyor 15 by means of a gripping and inverting means 13 which will be described later in detail in conjunction with FIGS. 7–10. The gripping and inverting means receives containers 11 from an infeed conveyor 12 to place them on conveyor 15. At the opposite end of the washing apparatus 10 is a similar unit 23 which grips the containers 11 and places them in an upright position on an outfeed conveyor 24. Washing apparatus 10 further includes a nozzle assembly 26 having a tie bar 27 for interconnecting air intake conduits 28 and water intake conduits 29. A plurality of manifolded nozzle members 30 are interconnected to the air intake and water conduits 28 and 29, respectively, and are supported at their base by means of connecting platform bars 31. Lift bars 32 are interconnected to tie bar 27 as well as connecting platform bars 31 so as to raise and lower nozzle members 30 by means of pneumatic cylinders 33 and guide cylinders 34 which are positioned on support brackets 35. As will be seen in comparing the position of the nozzle assembly 26 in FIGS. 1 and 2, in FIG. 1 the assembly is in its lower position whereas in FIG. 2 it is in its uppermost position where the nozzle members will engage the inside of containers 11. Although not shown in the drawings, a standard cam controlled mechanism will be employed for assuring that the nozzle rack assembly 26 will move up and down smoothly and squarely in sequence with the containers on conveyor 15.

Figure 3:
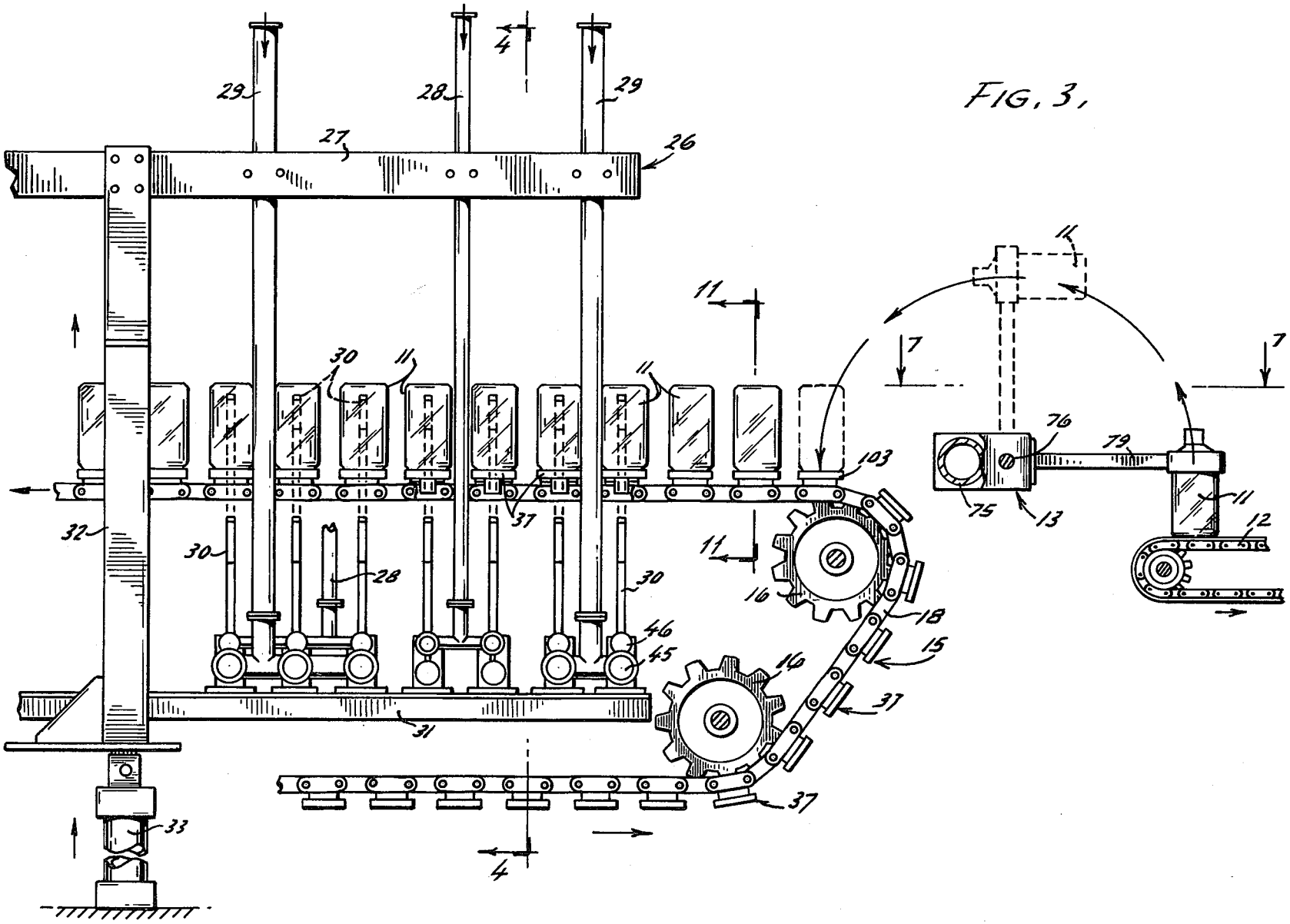
FIG. 3 is an enlarged view in side elevation illustrating the placement of the containers into the washing apparatus.

As best seen in FIG. 3, gripping and inverting means 13 places containers 11 in a releasable holding means assembly 37 which is secured to and is a part of conveyor 15. It will also be noted from the broken line showing of nozzle members 30 that when nozzle assembly 26 is in the raised position the nozzles will extend well into containers 11.

Figure 4:
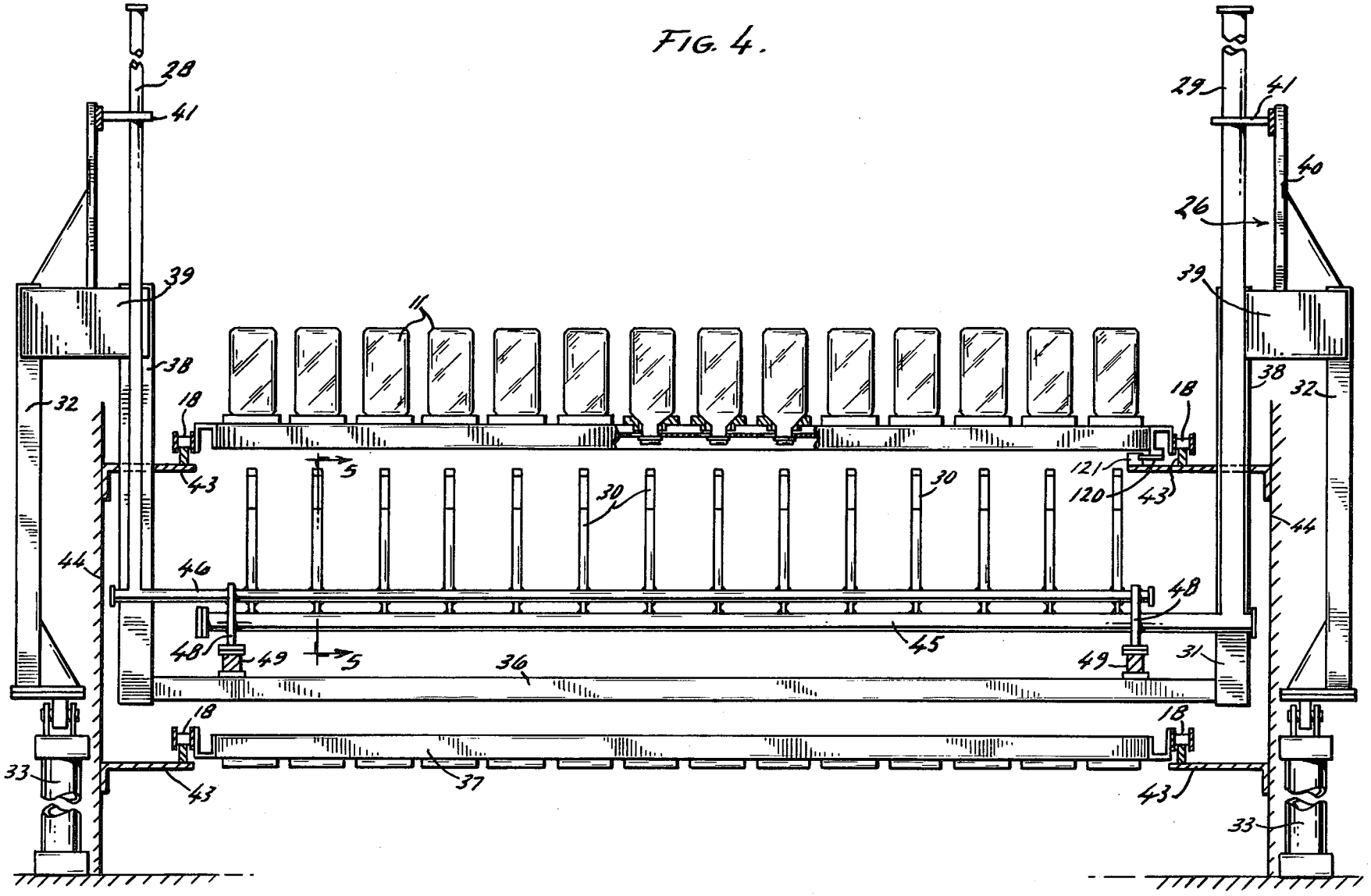
FIG. 4 is a view in vertical section taken along line 4—4 of FIG. 3.

In FIG. 4, the interconnection of the lifting mechanism for the nozzle assembly 26 is better illustrated. It will be noted that connecting rods 38 provide interconnection with connecting platform bars 31 and 36 by means of junction member 39 and ultimately with lift bars 32. The releasable holding means assembly 37 is secured to chain link 18 of conveyor 15 and is supported on conveyor supports 43 which in turn are secured to the support frame 44 of the washing apparatus. A water intake manifold conduit 45 provides water to nozzles 30 and is connected to water intake conduits 29. Similarly, air intake manifold conduit 46 communicates with nozzles 30 and is connected to air intake conduit 28.

Figure 5:
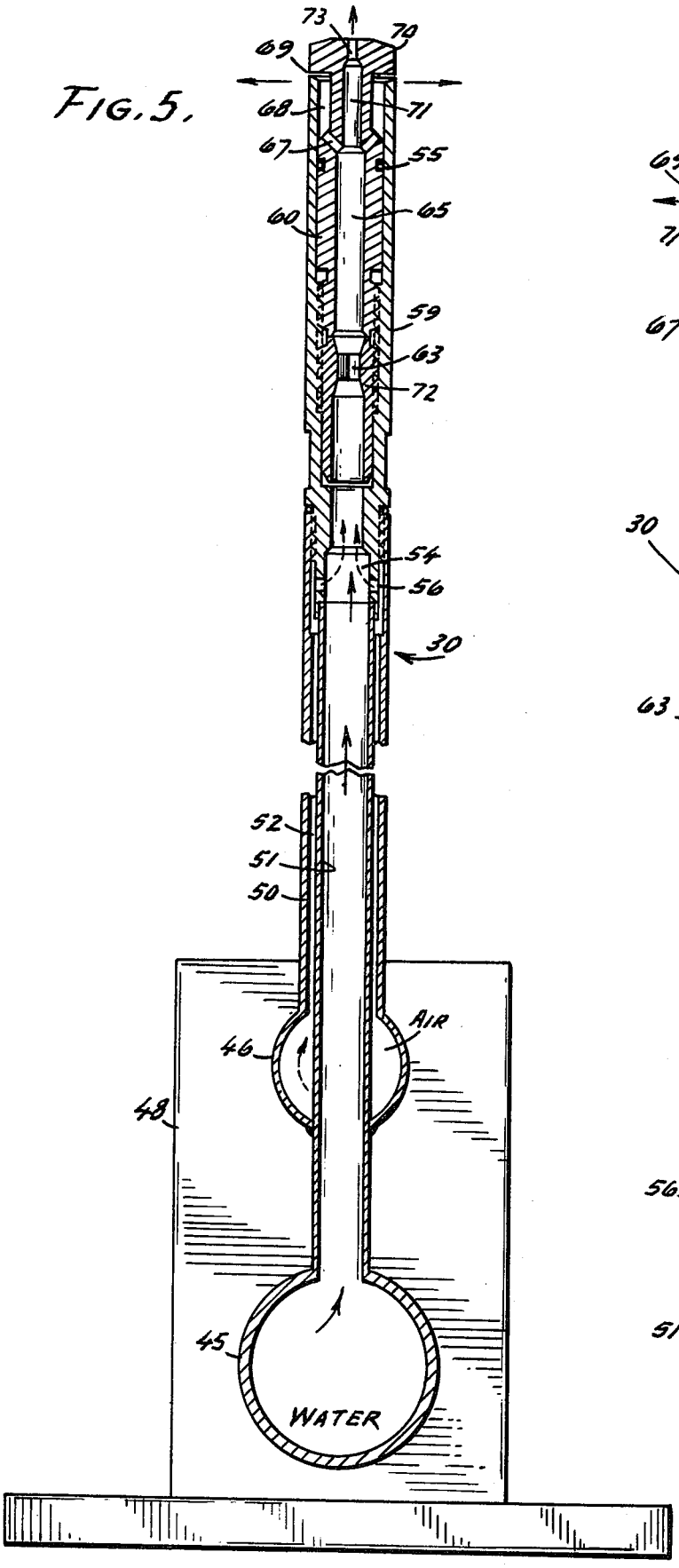
FIG. 5 is a view in vertical section of one of the nozzle units and the manifold supply conduits for the nozzles taken along line 5—5 of FIG. 4.
Figure 6:
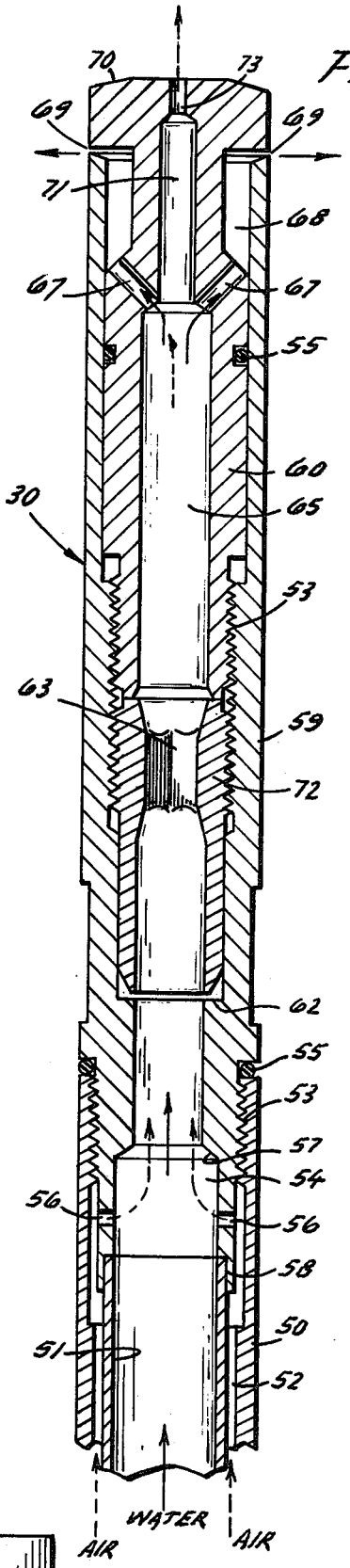
FIG. 6 is a view similar to FIG. 5 showing an enlargement of the nozzle head.
Figure 7:
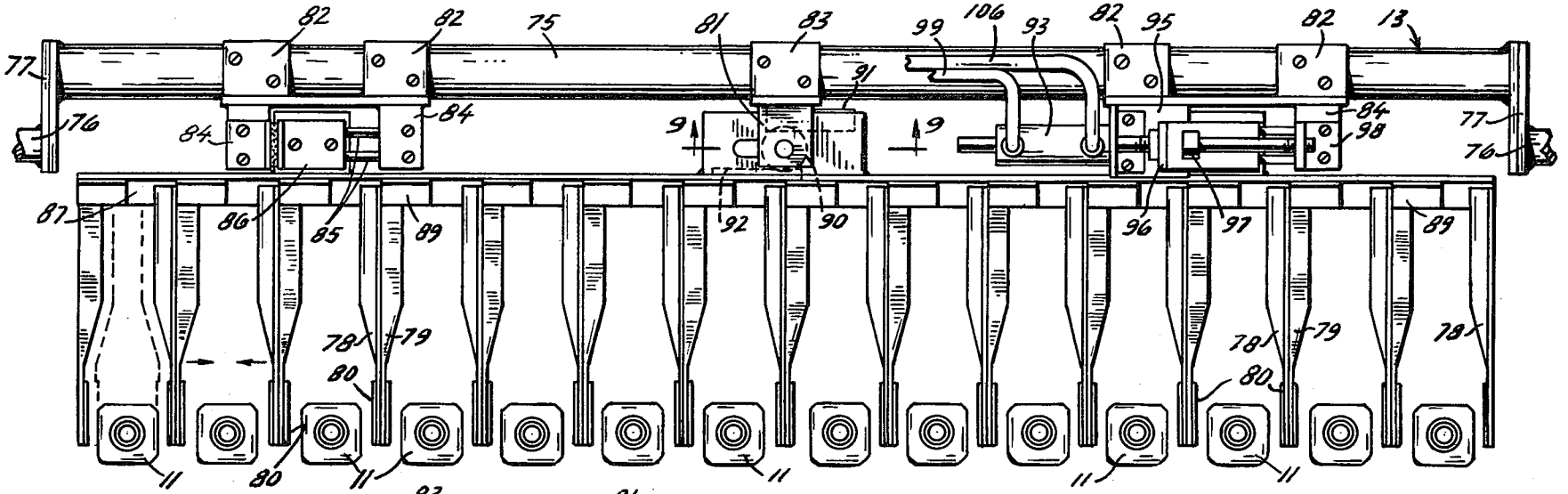
FIG. 7 is a horizontal view taken along line 7—7 of FIG. 3.
Figure 9:
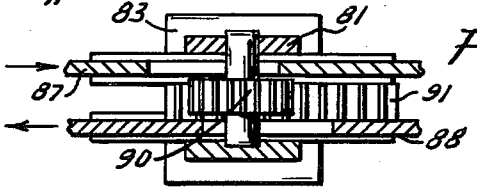
FIG. 9 is a view in vertical section taken along line 9—9 of FIG. 7.

The nozzle members 30 are best illustrated in FIGS. 5 and 6. It will be noted that water intake manifold conduit 45 communicates with the inside of an inner nozzle pipe or conduit 51 which is housed in and concentrically spaced from an outer nozzle pipe or conduit 50. Conduit 51 is shouldered at 58 with outer head nozzle pipe 59. Air intake manifold conduit 46 communicates with outer nozzle pipe 50 and the annular passage 52 formed between pipes 51 and 50 with pipe 50 threaded to outer head nozzle pipe 59 and 53. Openings 56 are provided in pipe 59 to provide communication between passage 52 and the passage 54 inside of outer head nozzle pipe 59, which, with pipe 51, forms a central passage. Pipe 59 has a shoulder portion 62 for abutment with inner head nozzle pipe 72. A hexagonal section 63 as viewed in horizontal section, is disposed inside inner head nozzle pipe 72 in the area of threads 53 joining outer head nozzle pipe 59 and inner head nozzle pipe 72. An intermediate chamber 65 is positioned in pipe 60 between portion 63 and a plurality of apertures 67 leading to an annular chamber 68 and ultimately to a lateral, annular aperture 69 which is formed from a spacing of head portion 70 from head nozzle pipe 59. Also interconnecting with intermediate chamber 65 is a head chamber 71 in communication with a smaller diameter straight-walled section 73. Suitable seals 55 provide fluid-tight fittings between pipes 50, 59 and 59, 60.

Figure 10:
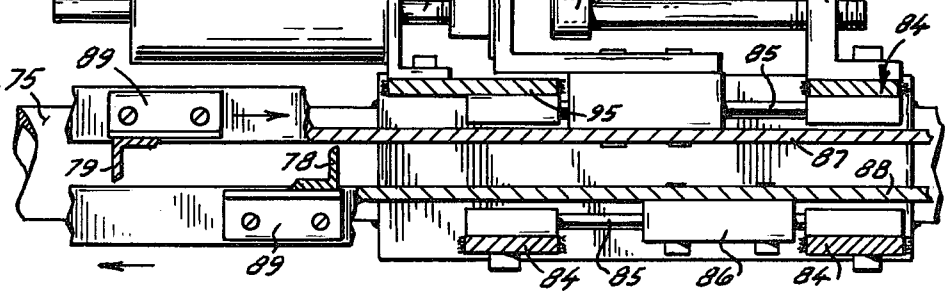
FIG. 10 is a view similar to FIG. 8 except showing another portion of the gripping device and the means to move the gripping arms of the gripping mechanism of FIG. 7.
Figure 8:
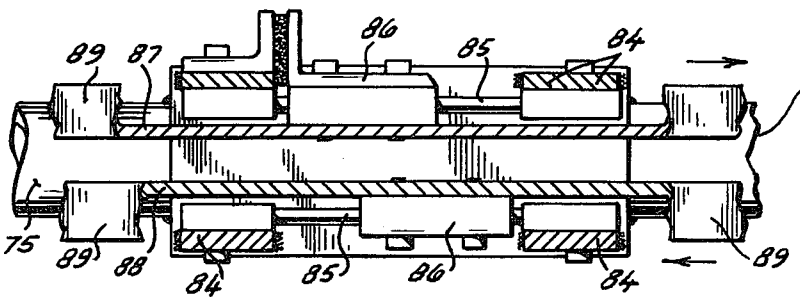
FIG. 8 is a partial view in vertical section of the gripping device shown in FIG. 7.

The gripping and inverting means 13 or the gripping and uprighting means 23 is described specifically in FIGS. 7–10. It is composed of a rotatable bar 75 which is actuated by means of pivot bar 76 through crank arm 77. Its basic motion is described in FIG. 1. Supported on arm 75 in a lateral slidable manner are a plurality of opposed, paired, gripping arms 78 and 79. They are supported from pivotal bar 75 by means of oppositely disposed clamp plates 82 from which extent support brackets 84 having disposed therebetween support bars 85. Riding on support bars 85 in a slidable manner are paired, slidable, oppositely disposed supports 86 which are ultimately connected to slide bars 87 and 88 which support gripping arms 79 and 78, respectively, by means of brackets 89. As will be noted in FIG. 9, central clamp plate 83 with paired and spaced support brackets 81 journals a pinion 90 for translating opposing motion to the slide bars 87 and 88. This is effected by having one gear rack 91 secured to an extended portion of slide bar 87 and an opposing gear rack 92 secured to an extended portion of slide bar 88. As best seen in FIG. 10, in place of a slidable support 86, a reciprocating member 96 is attached to slide bar 87 and is actuated by means of piston rod 94 in a standard pneumatic reciprocating cylinder 93 from which extend air intake and outlet conduits 99 and 106. A limiting stop member 97 for reciprocating member 96 is adjustably disposed on stop support bracket 98 extending from support bracket 84.

The releasable holding means assembly is particularly described in FIGS. 11–14. It is composed of a carrier bar 100 having opposing flanges 101 secured to chain link 18 of conveyor 15, which rests slidably upon conveyor support 43. A multiplicity of container holders or pocket members 103 are fastened to bar 100 and have an opening 104 for accommodating the tapering shoulder 116 of semirigid container 11. A retaining and release bar 105 is slidably received through a passage 110 in the container holder and has an enlarged rounded section 112 which will accommodate flange 115 of the semirigid container 11 as well as a small rounded section 113 which will surround bottleneck 117 but is dimensioned not to permit flange 115 to pass therethrough.

Combined retaining and release bar 105 is biased on flange portion 108 of flange 101 by means of spring biasing means 107 which is slidably received on a Z-shaped section 109 of retaining release bar 105. At the opposing end of release bar 105 is a Z-shaped camming flange 119 to which is secured a cam follower 120 for engaging a camming plate or surface 121 secured to the frame of the washing apparatus by means of cam support plate 123.

OPERATION

Figures 11, 12, 13, 14:
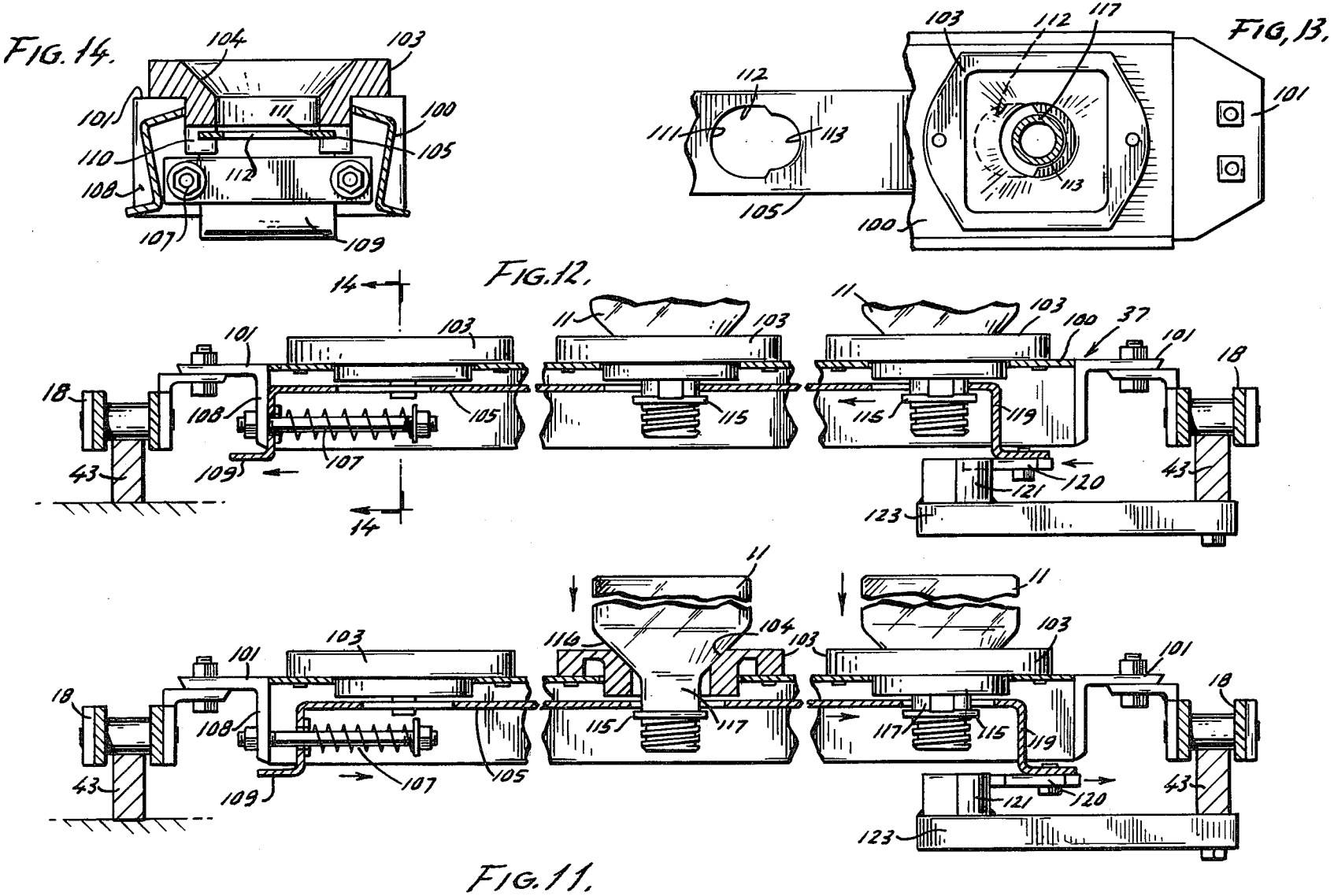
FIG. 11 is a view in vertical section taken along line 11—11 of FIG. 3 and illustrating the open position of the holding means for the containers.
FIG. 12 is a view similar to FIG. 11 except showing the releasable holding mechanism in the closed position.
FIG. 13 is a partial top view of a holding mechanism showing a cross section of the neck of a container as it would be retained in the holding mechanism.
FIG. 14 is a view in vertical section taken along line 14—14 of FIG. 12.

A better understanding of the advantages of the method and apparatus for performing it will be had by a description of the operation of washing apparatus 10. Semirigid containers 11 will be orientated on infeed conveyor 12 in a manner such that they will be aligned in lateral rows, preferably fourteen in number. Each container will be engaged by the gripping surfaces 80 of adjacent pairs of gripping arms 78 and 79. This will be effected by means of pivot arm 76 being rotated by suitable means so as to cause rotatable arm 75 to be moved by means of crank arm 77 so that the gripping arms 78 and 79 are positioned on either side of container 11 as indicated in the solid line showing of gripping arms 78 and 79 in FIGS. 1 and 3. With arms 78 and 79 so positioned and spaced from container 11, air cylinder 93 will be actuated so as to move reciprocating member 96 in the direction indicated by arrow 102 in FIG. 10. This will cause slide bar 87 to move in the same direction along with gripping arms 79. At the same time and by means of rack and pinion mechanism 90, 91 and 92, slide bar 88 will be moved in the opposing direction such as indicated by the arrows in FIG. 9. This will effect a movement of arms 78 and 79 toward each other and consequently engage the lateral surfaces of containers 11. When so engaged, pivot arm 76 will be actuated and move through a 180° arc as indicated in FIGS. 1 and 3 so as to place container 11 in an inverted position in container holder 103 where it can be locked in place by slidable holding member 105. It will be appreciated that prior to the insertion of containers 11 in the holders 103, a camming action of the combined retaining and release bar 105 will be effected such as indicated in FIG. 11 so as to position the enlarged section 112 of opening 111 beneath the opening 104 of the holder 103. This camming action is effected by cam follower 120 engaging the widest dimension of camming plate 121. When so positioned, conveyer 15 will be moved by means of motor 20, transmission 19 and drive sprocket 17. This will in turn move cam follower 120 along camming plate 121 to its narrower dimension and, as indicated in FIG. 12, will effect a movement of retaining and release bar 105 so that the spring biasing means 107 will position flange 109 against flange 108 to thereby orientate the smaller section 113 in opening 111 around bottleneck 117 and over flange 115, between flange 115 and bottle shoulder 116. This movement of the retaining and release bar 105 will firmly retain containers 11 in holders 103 as the releasable holding means assembly 37 is moved by chain link 18 over conveyor support 43. This action between gripping and inverting means 13 and each row of container holders 103 in releasable holding means assembly 37 will be continued in a sequential manner.

Figure 2:
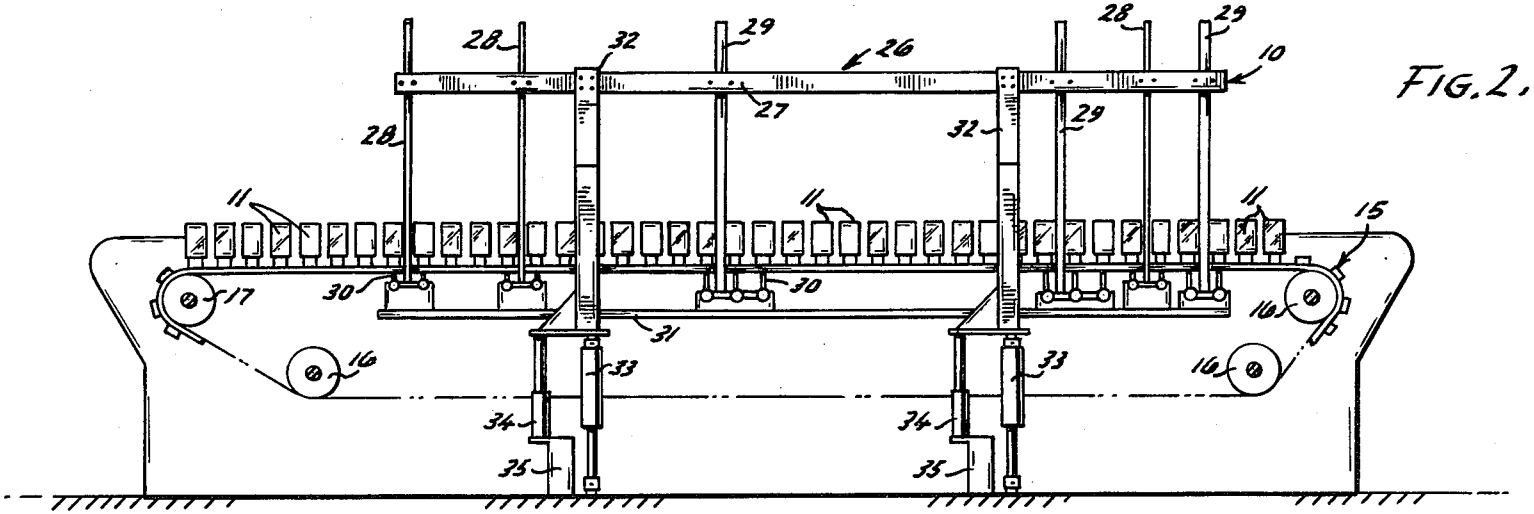
FIG. 2 is a view somewhat similar to FIG. 1 showing the washing nozzles in engagement with the inside of the containers.

As indicated in FIGS. 1 and 2 containers will be carried along conveyor 15 in a retained manner and will ultimately be orientated above nozzles 30. When so orientated, the conveyor 15 will be stopped and pneumatic cylinders 33 will be actuated to effect a lifting action on lift bars 32 so as to effect entry of nozzles 30 inside containers 11 as indicated by the broken lines of the nozzles in FIG. 3. Water will be supplied to water intake conduit 29 and air to air intake conduit 28. As the nozzles 30 enter the confines of containers 11, water and air will flow in water intake manifold 45 and air intake manifold 46, respectively, with the water flowing in inner nozzle pipe 51 and air in annular passage 52 whereupon the two fluid streams will be combined in passage 54 with the air entering through passages 56. After entry of the two combined streams in intermediate chamber 65, a portion thereof will flow out through apertures 67 into lateral chamber 68 and be directed outwardly in a radial and transverse manner to the longitudinal axis of the nozzle through annular lateral aperture 69 to effect a 360° flat spray. The second portion of the stream will flow through head chamber 71 and out through straight walled section 73 whereby a substantially cylindrical stream of water and air will emerge from head portion 70. The second stream will have an axis substantially parallel to the longitudinal axis of the nozzle with a pencil-like spray. Effective cleaning and rinsing action can be accomplished with nozzles 30 by having the air and water continuously flow out of the nozzles. Consequently, air and water will contact the inside of the container from the time the nozzles enter the confines of the containers 11 to their upmost position in the containers and until they leave the confines of containers 11 while contacting the side walls twice from their up and down motion. This up and down motion of the nozzles, of course, is accomplished by actuation of pneumatic cylinders 33.

It will also be noted in FIG. 1 that various manifolded sets of nozzles 30 are indicated. It will be appreciated that any number of such nozzles can be provided and the conveyor 15 indexed and orientated so as to move each container 11 over each row of nozzles in a sequential manner with an up and down cycle of the nozzles.

It can also be recognized that not only water and air would be introduced through the nozzle chambers and out through the outlets 69 and 72. For example, in the preferred manner, the washing apparatus 15 is actually separated into four distinct sections. In the first, in addition to the water being introduced into nozzle 30, a detergent will be added to the water along with the air and the containers moved over a plurality of nozzles. In a second section, fresh water will be introduced only with the air so as to provide a first rinse. In a third stage, recycled distilled water will be employed and in a fourth, distilled water which is used only once and then moved to the recycled distilled water station. In each instance of each station, numerous washings of each container and each portion of the inside are effected by the nozzle member entering the container and moving up and down therein. After being subjected to the previously described washing cycles and as the containers 11 are positioned at the extreme left-hand side as viewed in FIGS. 1 and 2, a camming plate will be provided and cam follower 120 will engage it so as to move the retaining and release bar as indicated in FIG. 11 so that the large section 112 of opening 111 is orientated with the neck 117 and flange 115 of the container. At this moment a gripping and uprighting means 23 which is an exact duplicate of gripping and inverting means 13 will be orientated and actuated so as to grip the containers in the manner previously described for gripping and inverting means 13 and to move them in a manner described by the arrows in FIG. 1. Accordingly, containers 11 will be positioned in an upright manner on outfeed conveyor 24.

It will be appreciated that during each step of the method as accomplished by washing device 10 whether it be the infeeding and placement of the containers on the conveyor, the washing cycles or the removal of the containers from the conveyor that the device provides a continuous method for effectively washing containers. High velocity and high volume fluids are provided as well as adequate rinse of the detergent which is highly important when the containers are filled with fluids to be used in parenteral administration. In actual practice, the water flow rate and pressure from each nozzle will range from 1 gallon per minute to 1½ gallons per minute at a pressure of 55 psi to 95 psi. Air will be introduced in the range of 60 psi to 100 psi. Washing apparatus 10 can effectively wash 120 containers per minute through numerous washing and rinsing cycles and with the entry of 14 nozzles per container. The washing device unit is highly versatile in that it can accommodate containers of various sized and various weights and is adapted to a variety of washing and rinse cycles.

It will be obvious to those skilled in the art that any suitable timing and indexing mechanisms can be provided so that conveyor 15 moves in sequence with gripping and inverting means and gripping and uprighting means 13 and 23, respectively, as well as with the raising and lowering of the nozzles 30 in the containers 11. Such a suitable indexing unit is known as Camco, manufactured by Commercial Cam & Machine Company, Chicago, Illinois, and is of the commercial cam parallel shaft type having a 90° index and a 270° dwell. Preferably washing unit 10 is indexed by the Camco index unit by indexing conveyor 15. Other portions of washing unit such as gripper mechanisms 13 and 23 and rack lifting mechanism composed of items 31–36 and 27 are mechanically tied together by suitable linkage and operate continuously. Further, it will be apparent that washing unit as particularly shown in FIGS. 1 and 2 would be enclosed in suitable paneling. Internal threads 53 are illustrated for attaching nozzle head pipe 59 to outer pipe 50. It is obvious that nozzle head pipe 59 could as easily be secured to inner pipe 51 in a similar manner.

It should also be noted that nozzles 30 are of a unique construction in that no external threads are employed in the nozzle head. This is very important as such exposed threads can harbor bacteria. Other novel features of the nozzles 30 are ease of disassembly for cleaning, the use of air mixed in the fluid stream to add velocity to the stream thus increasing impact of fluid stream on container walls, the possible adjustment of the annular orifice to increase or decrease flow and change the characteristics of the resulting streams and the method of locking such adjustment so it cannot change once it is set to the desired setting. This latter aspect of adjustment is provided by removing nozzle pipe 60 and inserting a wrench with a hexagonal surface into hexagonal section 63. A spacing is provided between the end of pipe 72 and shoulder 62 for this purpose.

The washing apparatus and method of this invention has been preferably described in conjunction with a semirigid container. However, rigid containers such as glass bottles could be used as well as flexible containers if properly supported.

It will thus be seen that through the present invention there is provided a method and washing apparatus which is highly effective in washing and rinsing containers. The unit is fully automatic and has a very high capacity for washing semirigid containers. In the unlikely event that any one or more nozzles should become plugged and be ineffective, suitable washing and rinsing is still provided as each container is moved sequentially over a plurality of nozzles performing the same function.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

I claim:

1. A nozzle member for use in a washing apparatus to introduce high velocity fluid and a cleaning material into a container for cleaning purposes comprising:

a first conduit means and second conduit means spaced from first conduit means to provide a passage, a nozzle head member in fluid-tight communication with said first and second conduit means defining a common chamber extending along a longitudinal axis of said nozzle member for mixing said fluid and cleaning material, at least one first annular aperture communicating with said common chamber to the outside of said nozzle head member, said annular aperture having at least one wall extending substantially transverse to the longitudinal axis of said nozzle member and a second aperture communicating with said common chamber and defined by a wall having an axis substantially parallel with the longitudinal axis of the nozzle member and extending from the nozzle head member and to the outside of said nozzle head member and spaced from said first aperture, said second aperture constructed and arranged to discharge a fluid stream that is essentially parallel to the longitudinal axis of said nozzle member and said first aperture constructed and arranged to discharge a fluid stream that is essentially transverse thereto, inner and outer pipe members defining said nozzle head member, said pipe members being internally threaded to each other, and adjustment means operatively associated with said inner pipe member to afford internal adjustment and locking of said inner pipe member.

2. The nozzle member as defined in claim 1 wherein said first aperture in said nozzle head is defined by a spacing of said inner and outer pipe members.

3. The nozzle member as defined in claim 1 further including sealing means disposed between said inner and outer pipe members and separating said first aperture from said pipe thread means.

4. The nozzle member as defined in claim 1 wherein said second aperture in said nozzle head member is defined by a straight walled cylindrical section.

5. The nozzle member as defined in claim 1 wherein said nozzle head member is attached to one of said conduit means by internal thread means.

* * * * *